US009656511B2

(12) United States Patent
Batzer et al.

(10) Patent No.: US 9,656,511 B2
(45) Date of Patent: May 23, 2017

(54) FILLING STATION AND METHOD OF FILLING AN ENVELOPE

(71) Applicant: BOEWE SYSTEC GmbH, Augsburg (DE)

(72) Inventors: Joseph Batzer, Leitershofen (DE); Helmut Foerg, Grossaitingen (DE); Thomas Huber, Stadtbergen (DE); Reinhard Seiler, Aindling (DE)

(73) Assignee: BOEWE SYSTEC GmbH, Augsburg (DE)

( * ) Notice: Subject to any disclaimer, the term of this patent is extended or adjusted under 35 U.S.C. 154(b) by 751 days.

(21) Appl. No.: 13/969,444

(22) Filed: Aug. 16, 2013

(65) Prior Publication Data

US 2013/0333330 A1 Dec. 19, 2013

Related U.S. Application Data

(63) Continuation of application No. PCT/EP2011/074296, filed on Dec. 30, 2011.

(30) Foreign Application Priority Data

Feb. 17, 2011 (DE) ..... 10 2011 004 344

(51) Int. Cl.
*B43M 3/04* (2006.01)

(52) U.S. Cl.
CPC ..... *B43M 3/045* (2013.01)

(58) Field of Classification Search
CPC ..... B43M 3/045; B43M 3/00
USPC ..... 53/473, 235, 249, 250
See application file for complete search history.

(56) References Cited

U.S. PATENT DOCUMENTS 3,423,900 A * 1/1969 Orsinger ..... B43M 3/045 270/58.06
4,020,615 A 5/1977 Irvine et al.
4,633,644 A * 1/1987 Haroutel ..... B43M 3/045 53/258
4,712,359 A * 12/1987 DePasquale ..... B43M 5/042 53/252

(Continued)

FOREIGN PATENT DOCUMENTS

DE 10101545 8/2002
EP 0671286 9/1995
EP 2149459 2/2010

*Primary Examiner* — Gloria R Weeks
(74) *Attorney, Agent, or Firm* — Michael A. Glenn; Perkins Coie LLP

(57) ABSTRACT

A filling station for filling an envelope is configured to receive a filling material and an envelope. The filling station includes a filling area including at least one filling aid, an envelope feeder configured to receive an envelope and to hold the envelope at least partly at a position outside the filling area, and a transport device configured to move an envelope, which is arranged in the envelope feeder, to the filling aid. The envelope feeder is configured to receive a further envelope during a movement of the preceding envelope from the envelope feeder to the filling aid and/or during filling of the preceding envelope. The transport device is configured to move the further envelope from the envelope feeder to the filling aid once filling of the preceding envelope has been completed and before transporting of the filled envelope out of the filling station has been completed.

18 Claims, 15 Drawing Sheets

(56) References Cited

U.S. PATENT DOCUMENTS

| | | | | | |
|---|---|---|---|---|---|
| 4,817,369 | A * | 4/1989 | Tribbey | B65B 25/002 | 53/284.3 |
| 5,282,350 | A * | 2/1994 | Crowley | B43M 3/045 | 53/168 |
| 5,618,375 | A * | 4/1997 | Suzuki | B43M 5/042 | 156/442.2 |
| 5,630,312 | A * | 5/1997 | Ballard | B43M 3/045 | 53/284.3 |
| 5,950,399 | A * | 9/1999 | Viens | B43M 5/042 | 53/284.3 |
| 6,494,019 | B1 * | 12/2002 | Lingle | B43M 3/045 | 414/797.4 |
| 8,312,698 | B2 * | 11/2012 | Munneke | B43M 3/045 | 270/58.06 |
| 2004/0080099 | A1 | 4/2004 | Janatka et al. | | |

* cited by examiner

FILLING STATION AND METHOD OF FILLING AN ENVELOPE

CROSS-REFERENCE TO RELATED APPLICATIONS

This application is a continuation of copending International Application No. PCT/EP2011/074296, filed Dec. 30, 2011, which is incorporated herein by reference in its entirety, and additionally claims priority from German Application No. 102011004344.6, filed Feb. 17, 2011, which is also incorporated herein by reference in its entirety.

The present invention relates to the field of paper handling, in particular to a filling station for filling an envelope, to a paper handling system, and to a method of filling an envelope in a filling station.

BACKGROUND OF THE INVENTION

Various enveloping principles are known from conventional technology. U.S. Pat. No. 7,475,522 B2 shows a filling station with direct feeding of the envelopes from above. Coming from the envelope leader, an envelope moves against a stop, is received by two worm wheels, is separated and is vertically inserted into the filling plane. Once the envelope has been opened and filled, the stop is opened and the envelope is transported out of the filling station. EP 1 275 523 A describes an approach to inserting a material into an envelope, the envelopes being fed from above, separated by worm wheels and fed to the filling station by means of the movement of the worm wheels. EP 1 473 173 A describes an enveloping machine wherein the envelopes are fed to the filling station from below. Feeding is performed by means of worm wheels, which are enabled for envelope output subsequent envelope filling.

The above-described filling stations for enveloping machines have short travel paths in the feeding of the envelopes to the filling station. In order to transport a subsequent envelope into the filling station, it is useful to bridge a movement path, which essentially corresponds to the thickness of the envelope and/or to the spacing of a screw channel. While the filled envelope is removed, the next envelope is already available for envelope opening. Avoidance of long travel paths and of the long dead times resulting therefrom enables that feeding of the envelopes to the filling need not be performed at high speeds; rather, low speeds may be used. Therefore, said approaches are suitable for large cycle outputs. U.S. Pat. No. 7,475,522 B2 relates to an embodiment of a filling station wherein the cycle output may amount to 30,000 envelopes/h. The short travel paths and the low speeds also enable compact design of the system.

However, the above-described known approaches or solutions are disadvantageous in that two of the three known solutions, namely the approaches described in U.S. Pat. No. 7,475,522 B2 and in EP 1 275 523 B1, disclose feeding of the envelopes from above. This is disadvantageous since in case of feeding being performed from above, a subsequent envelope can get caught in the window of the preceding envelope.

In addition, the three above-described approaches, wherein envelope filling is performed into an envelope with the flap located at the top and the throat opening located at the bottom, involve increased effort for preventing a collision of the material being introduced at the throat opening, and thereby significantly restrict format and shape flexibility. In addition, all of the above-described solutions provide a approaches without any lateral guide and/or without the envelope being spread open in the filling process, which considerably reduces process reliability and lowers the filling limit. Moreover, design and operation are expensive due to the worm wheels used.

According to the three solutions described above, opening the envelope as well as keeping it open are performed exclusively by means of blow air. However, this is reliable to a limited extent only, since, on the one hand, already minor adhesions on the inside of the envelope make it significantly more difficult to open the envelope by means of blow air only, and, on the other hand, keeping the envelope open by means of blow air only may result in that the filling material is partly or even completely "blown out" of the envelope.

SUMMARY

According to an embodiment, a filling station for filling an envelope, the filling station being configured to receive a filling material and an envelope, may have: a filling area including at least one filling aid; an envelope feeder configured to receive an envelope and to arrange the envelope at least partly at a position outside the filling area; and a transport device configured to move an envelope, which is arranged in the envelope feeder, into the filling area; the envelope feeder being configured to receive a subsequent envelope during a movement of the preceding envelope from the envelope feeder into the filling area and/or during filling of the preceding envelope, and to keep same outside the filling area, and the envelope feeder being configured to receive the subsequent envelope below a position where an envelope is filled.

According to another embodiment, a paper handling system may have: one or more paper handling components for providing a filling material; a filling station as claimed in claim 1; and a controller effective to control the paper handling component and the filling station.

According to another embodiment, a method of filling an envelope in a filling station which receives a filling material and an envelope may have the steps of: moving an envelope from an envelope feeder in the direction of a filling aid of the filling station, inserting a filling material into the envelope, and during movement of the envelope from the envelope feeder to the filling aid and/or during filling of the envelope, receiving a subsequent envelope in the envelope feeder such that at least part of the received envelope is arranged outside a filling area, the subsequent envelope being received below a position wherein an envelope is filled.

The present invention further provides a paper handling system comprising one or more paper handling components, such as a cutter, a merger, a collating station, a folding unit and/or a gathering web having one or more insert leaders in order to provide a filling material, and comprising a filling station in accordance with embodiments of the invention, a controller being additionally provided which is operative to control the paper handling component and the filling station.

In accordance with embodiments of the invention, the transport device is configured to move an envelope from the envelope feeder in such a manner that the envelope is pulled up onto the filling aid.

The envelope feeder may be configured to receive an envelope below a position wherein an envelope is filled, it being possible for the envelope feeder to be configured to hold an envelope bottom in a downwardly deflected manner in relation to the rest of the envelope while the envelope is being transported into the envelope feeder and/or while the envelope bottom is arranged in the envelope feeder. The envelope bottom may be held, e.g., by being received in a bay so as to effect the deflection, without which bay the envelope bottom is fixed in place within the receptacle. In other embodiments, provision may optionally be made for providing a clamping element for fixing the envelope bottom in place. Before filling of the envelope has been completed or before filling of the envelope is started, the envelope bottom is released, so that it is no longer downwardly deflected. In accordance with one embodiment, the envelope feeder includes a support consisting of one or several parts and comprising an end which is remote from the filling aid and is arranged below the position in which an envelope is being filled, so that an envelope bottom of an envelope being moved into the envelope feeder is downwardly deflected in relation to the rest of the envelope. In this manner, opening of the envelope throat may be assisted.

In accordance with embodiments of the invention, the filling aid may be arranged in a movable or stationary manner. The filling aid is operative to spread the envelope open and to protect the material being introduced against hitting an envelope side or the envelope bottom and against envelope adhesion.

In accordance with further embodiments, the filling station includes a further transport device configured to feed an envelope to the envelope feeder; the further transport device may be configured to feed an envelope to the envelope feeder in the material transport direction, perpendicularly to the material transport direction or counter to the material transport direction. Moreover, the further transport device may be configured to receive a plurality of envelopes in a shingled manner. In accordance with embodiments, the further transport device includes a suction-belt transport device, which is deactivated while an envelope is being moved from the envelope feeder onto the filling aid, and which is activated while an envelope is being filled. The suction-belt transport device may be configured to arrange the envelope within the envelope feeder outside the filling area. Alternatively, the further transport device may also include a segment transport device comprising active and non-active portions. The transport and the segment transport devices are controlled, or configured, such that an envelope ready to be moved into the envelope feeder has a non-active portion of the segment transport device associated with it while the transport device moves an envelope onto the filling aid, and such that the envelope ready to be moved into the envelope feeder has an active portion of the segment transport associated with it while an envelope is being filled.

In accordance with embodiments of the invention, the transport device may include a cylinder segment roller, so that when the envelope is being moved to the filling aid while using the cylinder segment rollers, a flap of an envelope which is already located within the envelope feeder or of an envelope being moved into the feeder is not impeded.

In accordance with further embodiments, the filling station includes a removal unit for removing a filled envelope, the removal unit being activated once the filling material has been inserted into the envelope.

In accordance with further embodiments, the filling station includes at least one filling slide so as to insert a filling material into the envelope pulled up onto the filling aid; the filling slide may further be provided to remove a filled envelope from the filling station.

In accordance with further embodiments of the invention, the filling station is implemented to receive a filling material which is being moved in a first direction, and to receive an envelope which is received from a second direction running counter to the first direction. The envelope feeder is configured to receive an envelope from a third direction, for example from a direction perpendicular to the first direction.

The envelope feeder may include a sheet metal, a wedge, a movable separation aid, one or more fingers or a guide so as to hold the envelope bottom downwardly deflected in relation to the rest of the envelope.

The filling aid may include a guide, one or more fingers, a sheet metal, or a packing bag.

The filling station may additionally include at least one further element, which opens an envelope for being filled and/or keeps an envelope open during filling; and further, a means may be provided for opening a throat of the envelope prior to pulling the envelope up onto the filling aid, i.e. to separate the envelope underside from the envelope top side, for example by means of one or more fingers or by means of blow air provided by one or more blowing nozzles.

The further transport device for feeding an envelope to the envelope feeder may also be implemented in the form of a pliers transport device, a finger transport device, or a roller transport device.

The filling station may include at least one means for avoiding a changing direction between an envelope during transport into the envelope feeder and an envelope during transport onto the filling aid. Moreover, a means may be provided for fixing the envelope in place at a filling position, for example while using one or more segment roller, one or more suction units acting upon the envelope flap from above or from below, one or more pliers, one or more lateral guide rails and/or a suction unit acting upon the envelope body from above. The suction unit may be configured as a suction ledge or as a suction sheet.

Embodiments of the invention thus provide a new approach to filling envelopes at a high cycle output within a wide format spectrum, the advantages of the known solutions having been retained, in particular, while their disadvantages have been eliminated. In accordance with embodiments of the invention, the envelope is transported "towards" the material in order to be filled and is pulled up onto the filling aid; in operation, at least two envelopes are located one above the other simultaneously, one within the filling area and a further one within the envelope feeder. In these positions, the envelopes are arranged in an at least partially overlapping manner when viewed from above. In addition, filling aids are employed for ensuring the filling process. Active elements such as worms or transport wheels, which are used by the known solutions, are replaced by passive elements and/or alternative embodiments; for example, instead of the worms/transport wheels, a passive element is employed for separating the at least two envelopes located within the filling station, e.g. an element in the form of a slope, a holder or an edge or the like.

In accordance with further embodiments of the invention, envelope feeding is performed such that a window of an envelope faces downward, so that guidance for the filling material, e.g. adaptation to the throat opening shape, is easier to implement. In addition, the envelopes to be filled are arranged to be positioned one below the other, which results in the next envelope being ready to be filled already once the filled envelope has been removed.

One advantage of the inventive solution consists in that an enveloping machine is provided which has a high cycle output, can process a large format spectrum, comprises a low number of components and functional parts that may be used, comprises compact system space and/or little enclosed space, comprises short travel paths of envelopes and filling material, and shows no decrease in performance as the format height of the envelope increases.

One advantage of embodiments of the invention consists in that the windows and the flap of the envelope are located at the bottom, so that the resulting problems as were discussed above in conventional technology no longer exist. Moreover, a compact dimensions of the filling station results which comprises only low filling speeds and short cycling times and, thus, large cycle outputs. In addition, the filling station is characterized by a small number of components and by the fact that the feeding performance of the envelopes is independent of the envelope height.

BRIEF DESCRIPTION OF THE DRAWINGS

Embodiments of the present invention will be detailed subsequently referring to the appended drawings, in which.

DETAILED DESCRIPTION OF THE INVENTION

Figure 1:
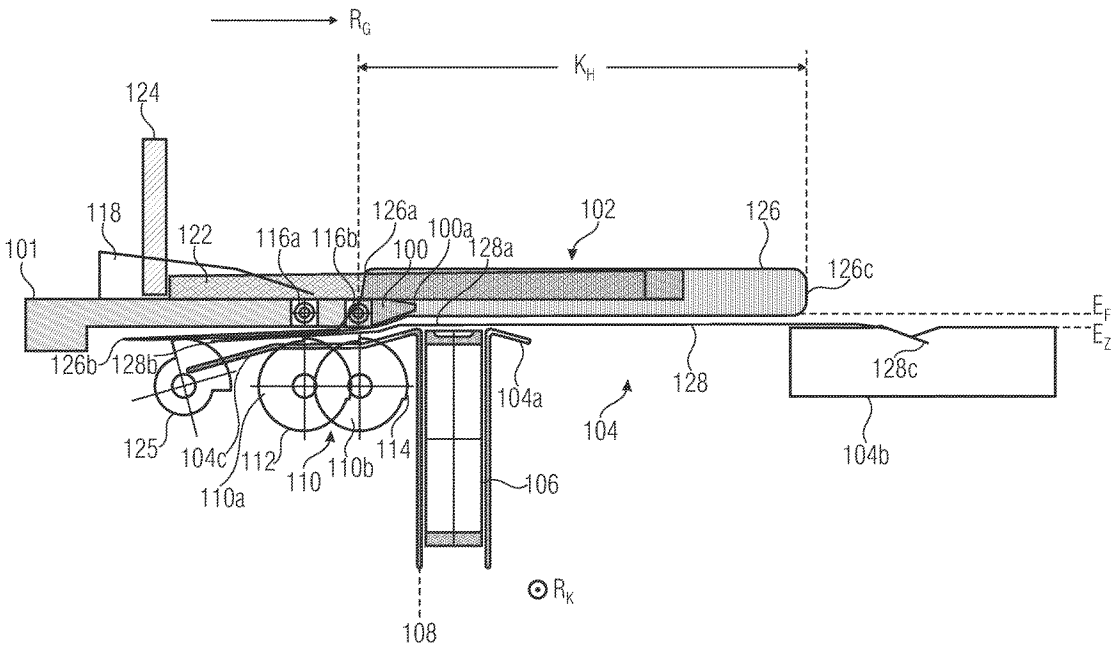
FIG. 1 shows a schematic, lateral sectional view of a filling station in accordance with an embodiment of the invention.

In the following description of the embodiments, elements which are identical or have identical functions are provided with identical reference numerals.

FIG. 1 shows a schematic, lateral sectional view of a filling station in accordance with an embodiment of the invention. The filling station includes a stationary filling aid 100 including, e.g., a plurality of fingers which are arranged next to one another in parallel and onto which an envelope may be pulled up at least partially in that an envelope is moved to the filling aid 100 so that the filling aid 100 is arranged in a throat opening of the envelope. The filling aid 100 includes ends 100*a* which first come into contact with an envelope while same is pulled up onto the filling aid. In the embodiment shown, the fingers 100 taper in the direction of the ends 100*a*. The fingers 100 may be part of a material feeding sheet 101; however, they may also be configured as elements separated therefrom.

The filling aid 100 is arranged within a filling area 102 which starts from the filling aid 100 and extends along the material transport direction $R_G$ by a distance which essentially corresponds to an envelope height $K_H$ (=dimension of the envelope between the envelope bottom and the hinge line=edge where the flap of the envelope is attached to the envelope body) of an envelope pulled up onto the filling aid 100. A filling plane $E_F$ is defined essentially by a plane wherein the fingers of the filling aid 100 extend and/or wherein the top surface of the envelope pulled up (=side where the flap is arranged) is disposed.

The filling station further includes an envelope feeder 104 for receiving an envelope. The envelope feeder 104 includes a support 104*a*, 104*b* and 104*c* consisting of several parts for receiving an envelope which has been fed in. The support includes a first portion 104*a* in the form of a sheet, upon which a top portion of a fed-in envelope rests, as well as a back portion 104*b* configured to downwardly deflect an envelope bottom in relation to the rest of the envelope. The portions 104*a* and 104*b* define an envelope feeding plane $E_Z$ arranged below and in parallel with the filling plane $E_F$. The filling area 102 extends vertically up to the support and/or the plane $E_Z$. Depending on how a subsequent envelope is fed in, said envelope may be arranged to be offset in relation to the envelope currently being filled, so that the longitudinal and/or transverse sides of the envelopes are not aligned. That area wherein the envelopes are arranged to completely or partly overlap is considered to be the filling area.

The envelope feeder 104 further includes a flap support 104*c* which extends from the suction-belt transport device 106 counter to the material transport direction $R_G$ and is arranged below the filling aid 100 and the material feeding sheet 101. An envelope arranged in the envelope feeder 104 is held by the portions 104*a* and 104*b* on its envelope body, and the envelope flap rests upon the support 104*c*. An envelope is fed to the envelope feeder by means of a suction-belt transport device 106, the suction-belt transport device 106 being arranged, in the embodiment shown, at a position located downstream from the filling aid 100 in the material transport direction $R_G$, so that a top end of the envelope is contacted for transport purposes. In accordance with the envelope shown, the suction-belt transport device 106 feeds an envelope from an envelope transport direction $R_K$ to the filling station, the envelope transport direction $R_K$ being perpendicular to the material transport direction $R_G$.

The filling station further includes a transport device 110, which in the embodiment represented is formed by two segment rollers 110*a* and 110*b* arranged one behind the other in the material transport direction $R_G$. The segment rollers 110*a* and 110*b* are configured such that the roller has a first radius along a first portion 112 of the circumference of same and has a second radius along the second portion of the circumference, the second radius being larger than the first radius. The transport device 110 serves to move an envelope arranged in the envelope feeder 104 counter to the material transport direction $R_G$ and to pull same up onto the filling aid 100, as will be explained in more detail below. In accordance with the embodiment shown, the envelope is transported by activating the transport rollers 110 engaging with an envelope flap, the envelope flap being arranged between the rollers 110*a* and 110*b*, specifically between their portions 114 and counter rollers 116*a*, 116*b*. The rollers 116*a* and 116*b* interact with those portions of the segment rollers 110*a* and 110*b* which have the larger radius. Thus, a movement of the transport rollers 110 causes a movement of an envelope, located within the envelope feeder 104, in the direction toward the filling aid 100 such that a throat opening arranged at the position 108 within the envelope feeder is displaced counter to the material transport direction $R_G$, so that the filling aid 100 may engage into the throat opening of the envelope and so that, therefore, filling of the envelope is assisted.

The filling station further includes a lateral material guide 118 as well as a blowing nozzle (not shown) to support initial opening of the envelope throat when the envelope is being pulled up onto the filling aid 100.

A filling material 122 is moved along the material transport direction $R_G$ by means of a filling slide 124. In the embodiment shown, the filling slide 124 serves to supply filling material, on the one hand, and to remove the filled envelope from the filling station, on the other hand.

In addition, the filling station includes a clamping element 125, e.g. in the form of a clamping roller (segment roller)

serving to fix a flap of an envelope in place during filling. Alternatively, a suction unit, which is arranged, e.g., in or on the material feeding sheet 101, may also be used. In accordance with other embodiments, no additional clamping element 125 is provided; instead, its function is taken over by the transport rollers 110 which, once an envelope has been pulled up, remain in their positions and retain the flap between the rollers 110*a*, 110*b* and the rollers 116*a*, 116*b*. The flap is released once the filling process has been completed.

FIG. 1 depicts a situation wherein a first envelope 126 is being filled, i.e. a filling material 122 is being inserted. The envelope 126 is pulled up onto the filling aid 100, so that the ends 100*a* of the latter are arranged within the throat opening 126*a* of the envelope 126 and open the envelope 126. The flap 126*b* is arranged below the sheet 101 and clamped, e.g., by the roller 125. An envelope bottom 126*c* is released, i.e. it is not downwardly deflected in relation to the rest of the envelope. By means of the release, the envelope bottom returns into its original alignment because of the elasticity of the envelope, so that the envelope is located within a plane in an essentially flat manner. The filling material is inserted into the opened envelope 126 by means of the slide 124. In addition, a second, non-filled envelope 128 is shown which is located within the envelope feeder 104. The throat opening 128*a* of the second envelope rests on the portion 104*a* and is located at the position 108, which is located immediately in front of the ends 100*a* of the filling aid 100, so that upon movement of the envelope 128 counter to the material transport direction $R_G$, its throat opening directly engages with the ends 110*a* of the filling aid. This arrangement involves bridging of only a short distance so as to pull up the envelope onto the filling aid and, thus, it may use little time. The flap 128*b* rests on the flap support 104*c*, and the envelope bottom 128*c* is held and downwardly deflected in the area 104*b* of the envelope feeder.

Starting from the situation shown in FIG. 1, i.e. after the envelope 126 has been filled and before the envelope is removed from the filling station, i.e. before the filled envelope has left that area of the filling station wherein the envelope feeder 104 is located, there is a movement of the envelope 128 arranged in the envelope feeder 104 counter to the material transport direction $R_G$ so as to pull up the envelope onto the filling aid 100. In the embodiment shown, the movement is effected by means of the segment rollers 110 such that at least part of the envelope is pulled up onto the filling aid 100, so that the latter may engage into the throat opening 128*a* of the envelope 128 so as to open same, so that a filling material 122 may now be inserted into the envelope 128 now located in the filling position.

The functionality of the filling station described by means of FIG. 1 is such that an envelope removed from an envelope leader is fed in from the side; an envelope window, if present, and the envelope flap 128*b* being located at the bottom, and the throat opening 128*a* pointing upward. The envelopes are transported, with their flaps opened into the filling station from below, for example via the suction belt 106, and are positioned there. The envelope 128 is received within a guide on the bottom side when being transported into the filling station, and is oriented outside the filling plane on the envelope bottom 128*c*. Lateral positioning of the envelope may be effected, e.g. via leaders, edges or traps, or directly by the suction-belt transport device 106.

The envelope 128 thus transported into the filling station is gripped, after positioning has been effected by the cylinder segment rollers 100*a*, 110*b*, as a function of the maximum envelope flap, by the envelope flap 128*b* by one or more cylinder segment rollers 100*a*, 110*b* and is transported on a predetermined travel path in the direction of the filling material (counter to the material transport direction $R_G$) and is pulled up onto the filling aid 100 and a lateral material guide which may be present. In this manner, the envelope bottom 128*c* is released and is transported completely into the filling area of the filling station. To enable transport in this direction, the suction-belt transport device 106 is deactivated; instead of the suction-belt transport device a segment transport device having active and non-active areas may also be provided alternatively.

Once the envelope has reached its final position, it may be fixed in position, during filling of the envelope, for example by the roller 125, by suction ledges mounted at the bottom of the envelope guide, and/or via suction ledges mounted on the lateral material guides. Filling of the envelope is effected by means of the filling slide 124, which conveys the filling material 122 into the spread-open envelope. Once filling of the envelope has been completed, fixation of the envelope is released, and the envelope may be removed from the filling station via the filling slides, for example.

Whereas the first envelope in the filling station is gripped by the segment rollers and pulled up onto the filling aids, a second envelope is transported into the filling station below the first envelope. By suitable means, such as blow air, start-up slopes, edges or traps, for example, damaging of the envelope during feeding is prevented. Collision with the transport elements of the filling station is avoided in that the transport elements are configured as cylinder segment rollers which do not impede feeding of the flap of the new envelope. Preferably, a maximum of two envelopes are positioned one below the other in the filling station.

Performing the above-described processes, namely filling/removing and feeding a new envelope, in parallel enables that a further envelope is available immediately after filling and prior to completion of removal of the filled envelope, whereby high performances are achieved. In contrast to known solutions, the inventive approach is advantageous since the envelope height has no influence on the feeding performance. The envelope height is that dimension of the envelope which extends from the envelope bottom to the edge where the flap of the envelope is attached to the envelope body, the so-called hinge line. This independence of the envelope height is achieved in that inward transport of the envelope is performed at the height of the hinge line. In FIG. 1, the position of the hinge line of the introduced envelope is the position 108.

By means of the following figures, a description will be given of an operational sequence for filling an envelope while using the inventive filling station. The following operational sequence will be presented below for the following conditions: envelope feeding is effected from the side, the feeding being clocked, and the envelopes having predetermined distances. The windows of the envelopes point downward, and two envelopes are arranged one below the other in the filling station at the same time. One envelope is pulled up onto the filling aid by a predetermined distance, a suction unit for opening the envelope being dispensed with. The following description is based on a functionality wherein a next envelope is not transported into the filling station until the preceding envelope has reached the filling position, and a filled envelope is not output until the new envelope has been completely transported into the filling station, so that movement overlaps are avoided.

Figure 2:
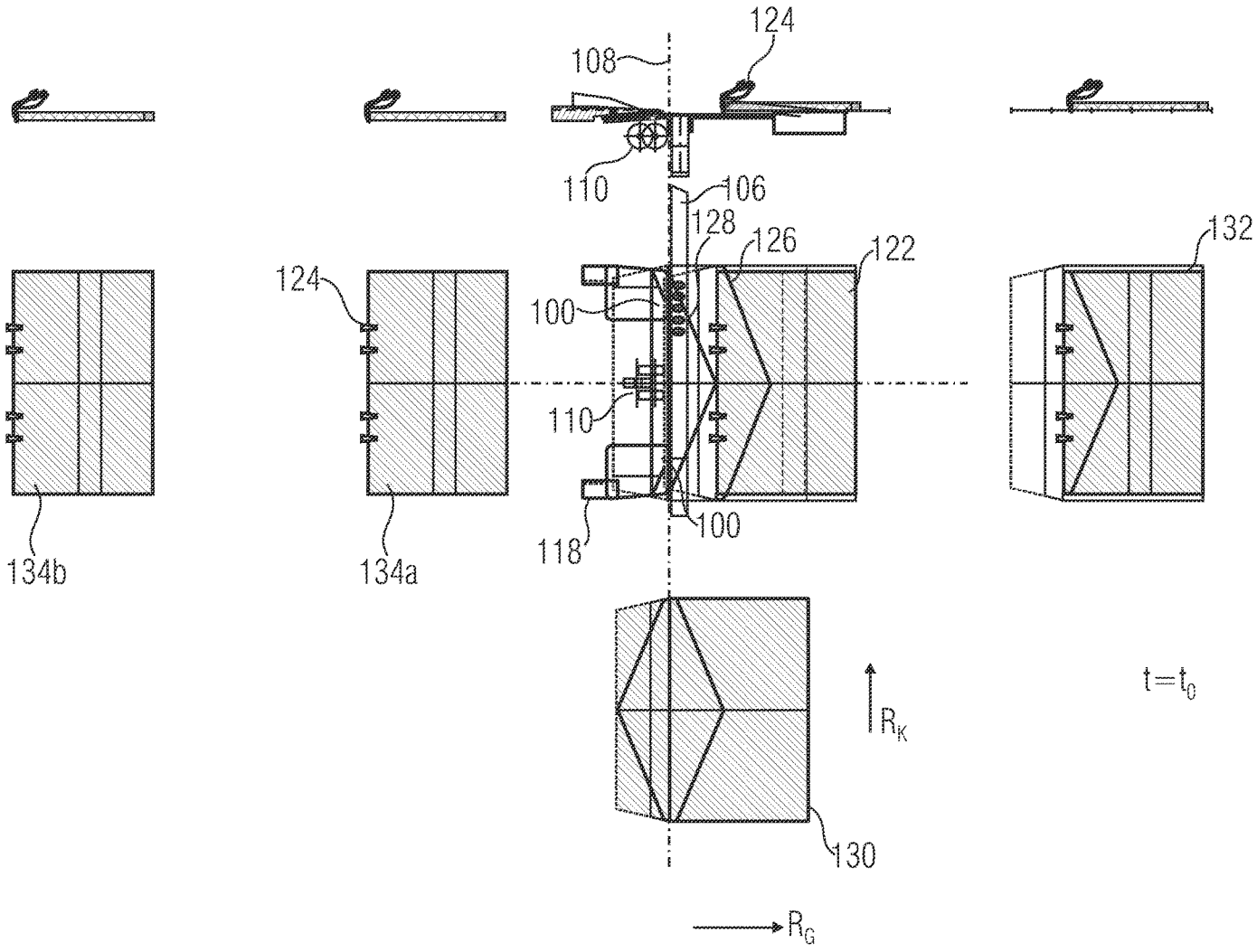
FIGS. 2 to 14 show representations of the process of envelopes being filled while using the inventive filling station by means of a representation of the condition of the filling station and the envelopes and materials located therein at different points in time between a starting position ($t=t_0$) and an end of the filling process ($t=t_{12}$)

FIG. 2 shows a "starting situation" ($t=t_0$), wherein on the basis of the situation illustrated in FIG. 1, filling of the envelope 126 has already been completed, and the filled envelope is no longer pulled up onto the filling aid 100. In its top area, FIG. 2 shows a lateral representation, and in its lower area a top-view representation. In FIG. 2 the filled envelope 126 containing the filling material 122 is removed from and spaced apart from the filling aid 100 to such an extent that the bottom envelope 128 can be opened and pulled up onto the filling aid 100, the envelope 126 located at the bottom in the filling station starting to move toward the material with a movement by a predetermined distance. In addition, FIG. 2 shows a further envelope 130 available for being fed to the filling station; envelopes which are transported in from the sides have predetermined distances. FIG. 2 further shows an envelope 132 which has already been filled and is located downstream from the filling station. Two groups of filling materials 134*a* and 134*b* which are to be inserted into envelopes are shown upstream from the filling station, the group of filling materials 134*a* having to be inserted into the envelope 128, and the group of filling materials 134*b* having to be inserted into the envelope 130.

Figure 3:
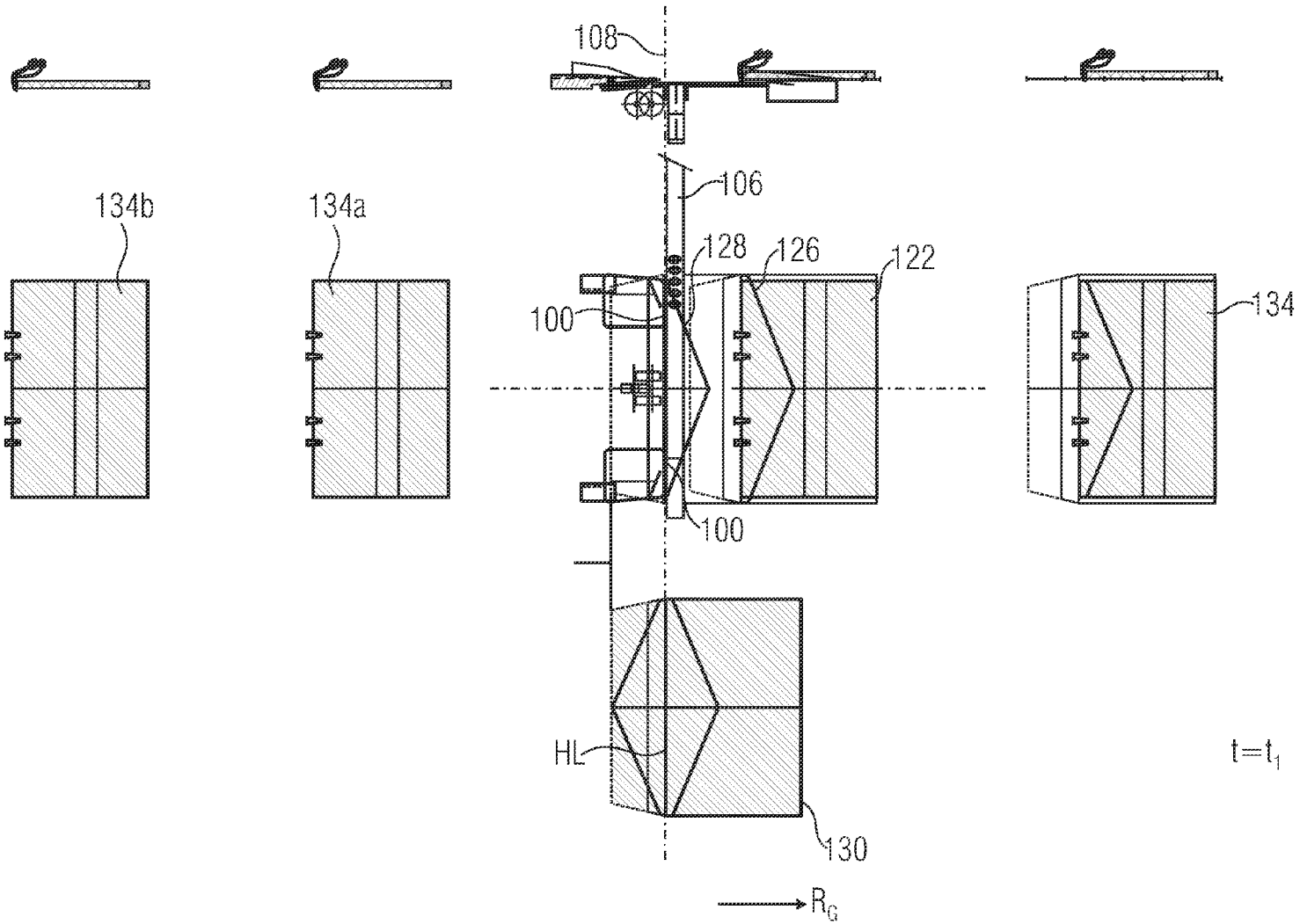

FIG. 3 shows the position of the individual elements after the time $t=t_1$. At this time, pulling the envelope 128 up onto the filling aids 100 is started, the filled envelope 128 already having moved on. However, the beginning of pulling the new envelope 128 up onto the filling aid 100 starts already before the filled envelope 126 has been completely transported out of the filling station, i.e. while the new envelope is being pulled up onto the filling aid 100, both envelopes are arranged one above the other in the filling station, which is advantageous since one does not have to wait for the envelope 126 to be completely transported out of the filling station; rather, an envelope can already be provided for the next filling operation while the filled envelope 126 is being transported out of the filling station, which results in an increase in throughput. In the situation shown in FIG. 3, the envelopes 128 and 130 are still arranged with their hinge lines HL at the position 108 directly upstream from the filling aid.

Figure 4:
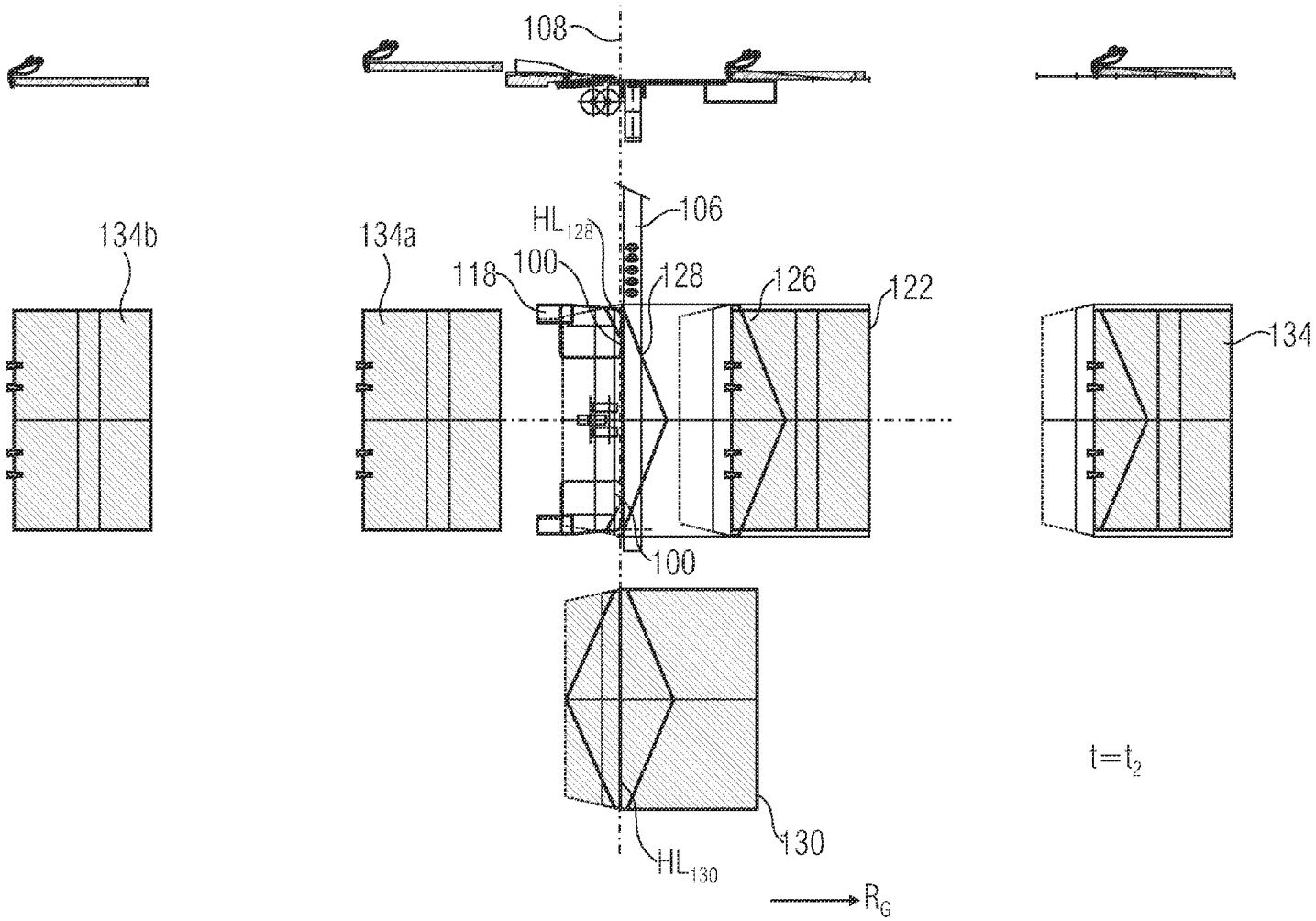

FIG. 4 shows the situation at the time $t=t_2$ (=a time period $t_2$ after the starting position shown in FIG. 2). The filled envelope 126 was already transported off by a further distance in the material transport direction $R_G$, whereas the new envelope 128 was already moved in the direction of the filling aids 100 so that its hinge line $HL_{128}$ is located at a position upstream from the position 108 in the material transport direction $R_G$, whereas the position of the hinge line $HL_{130}$ of the envelope 130 to be newly fed is still at the position 108. As may be seen from a comparison of FIGS. 2, 3 and 4, the filling material 134*a* to be inserted into the envelope 128 has also been moved in the direction of the filling station during this time period, and in FIG. 4 it has almost reached the lateral guides 118.

Figure 5:
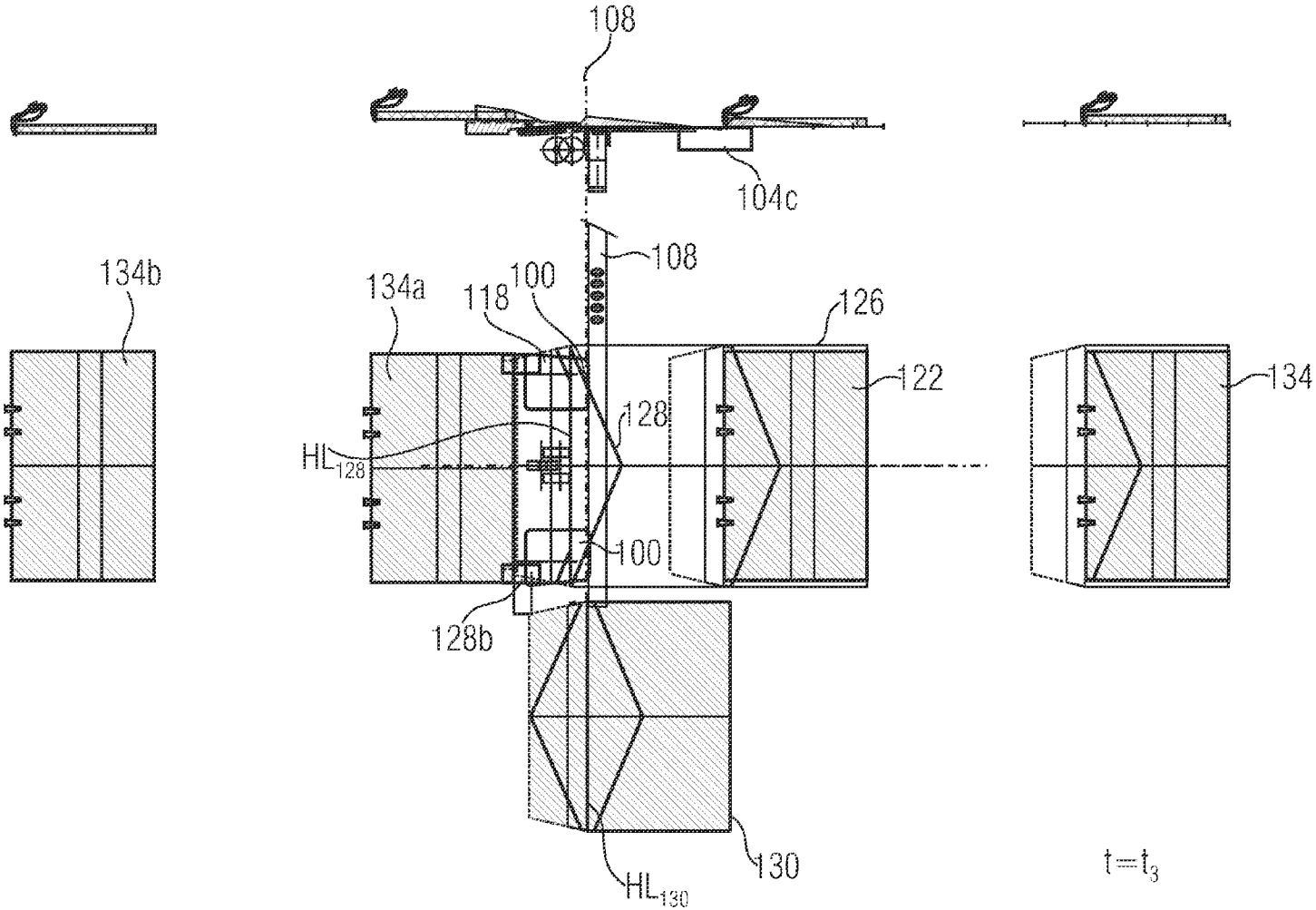

FIG. 5 shows the situation after $t=t_3$, wherein the envelope 126 was transported off further and has almost left the area of the envelope feeder as is shown at 104*c*. The new envelope 128 is now pulled up onto the filling aid 100 by the predetermined distance, and the filling material 134*a* has reached the guides 118.

Figure 6:
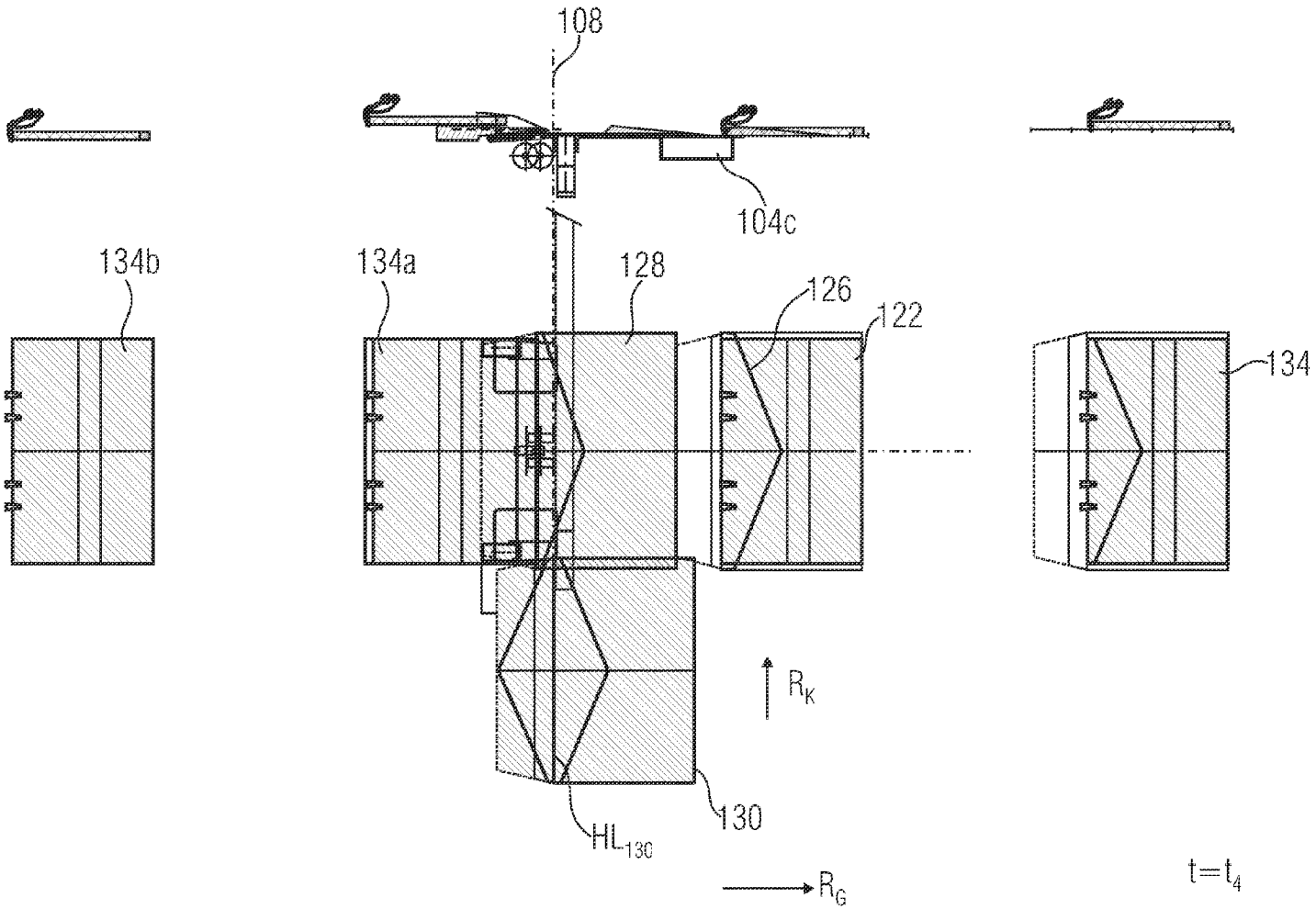
Figure 7:
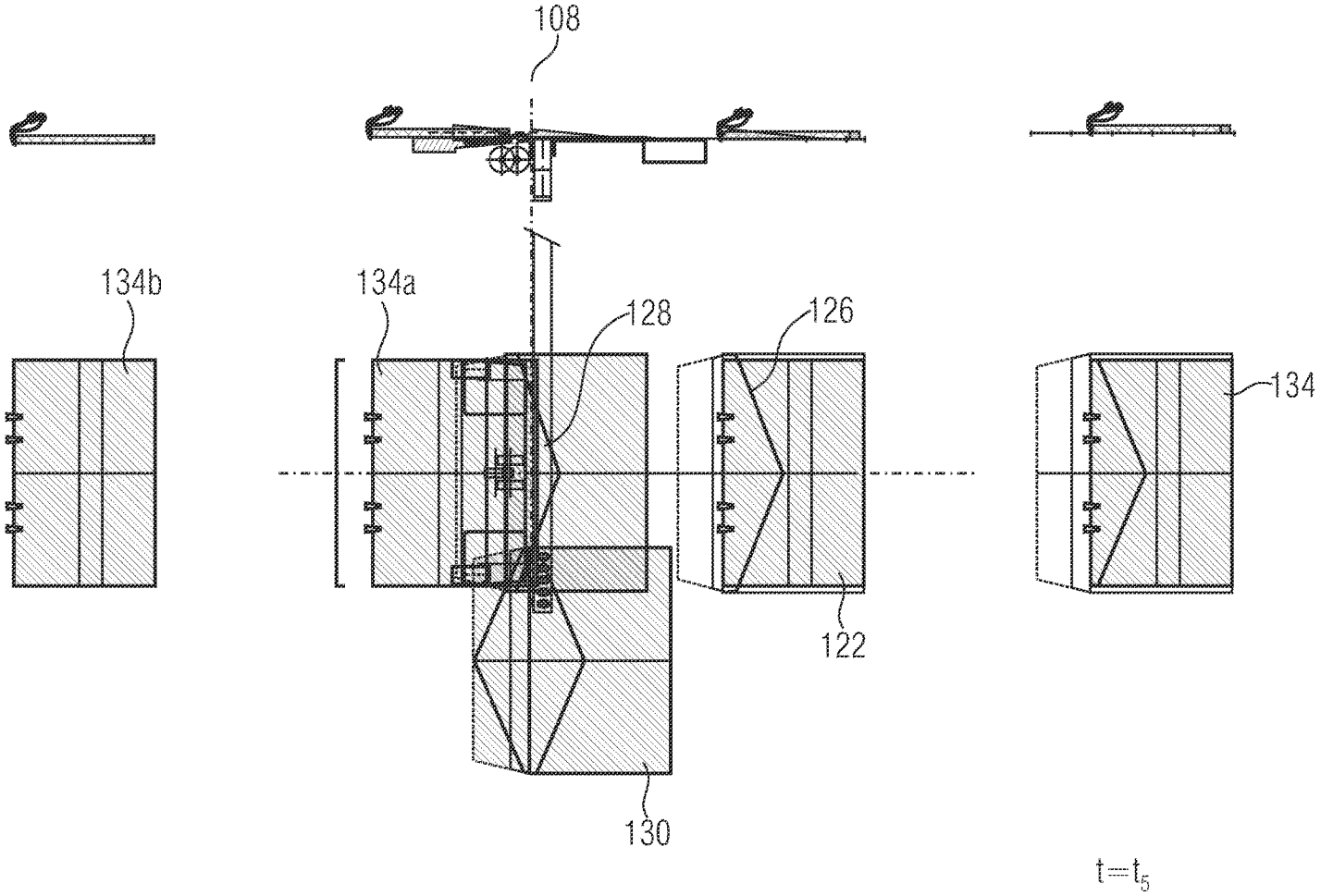
Figure 8:
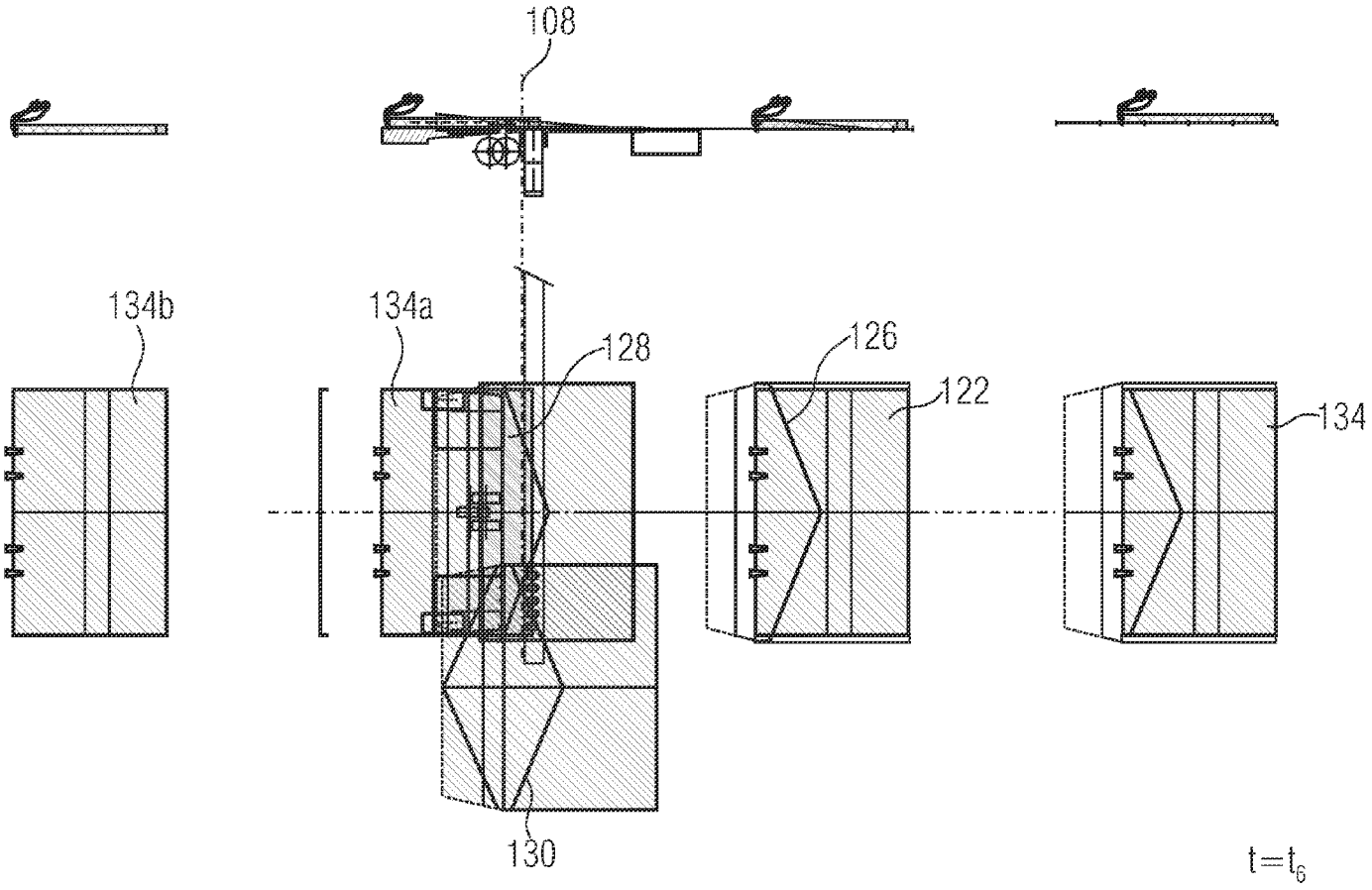
Figure 9:
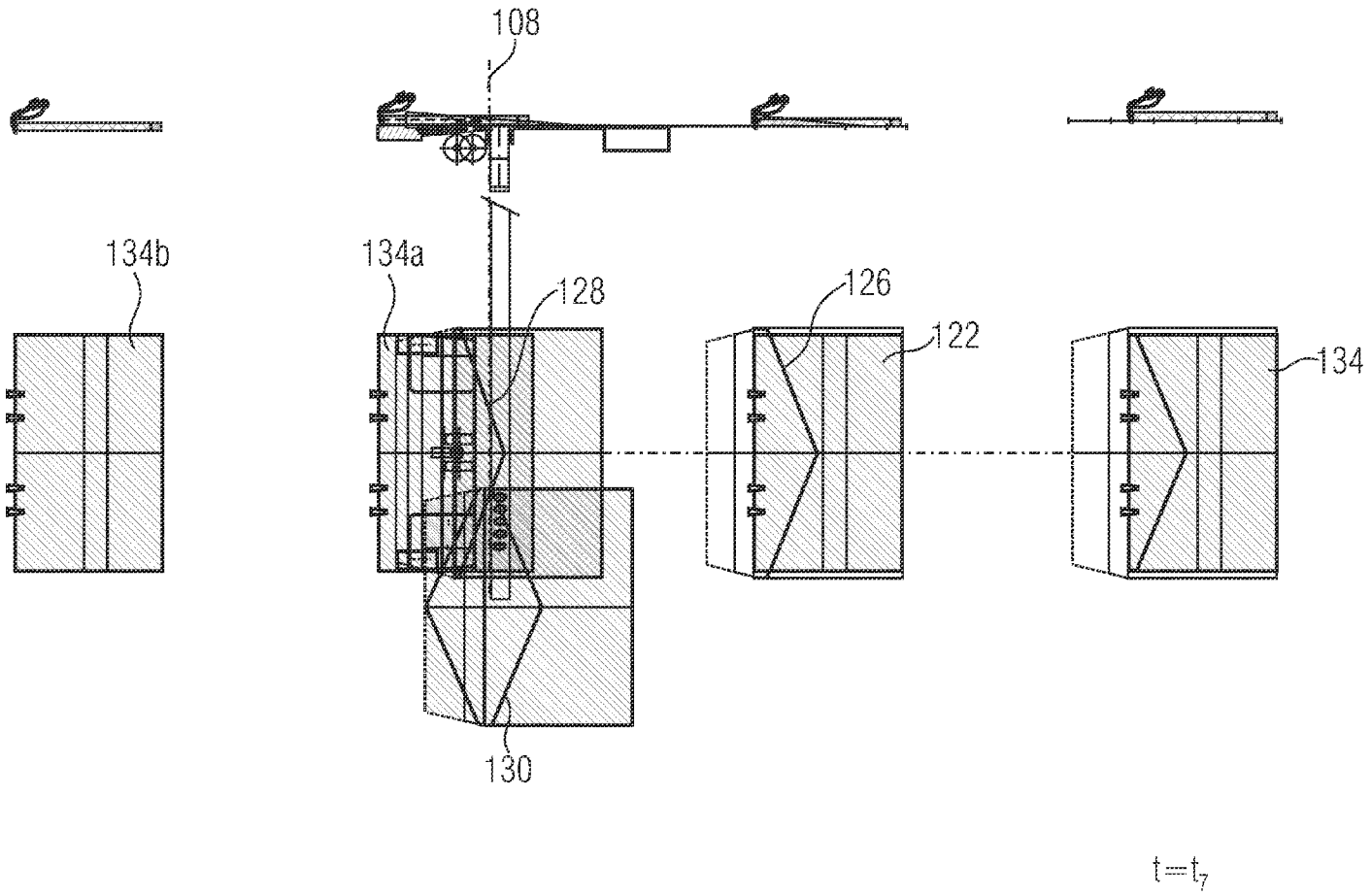
Figure 10:
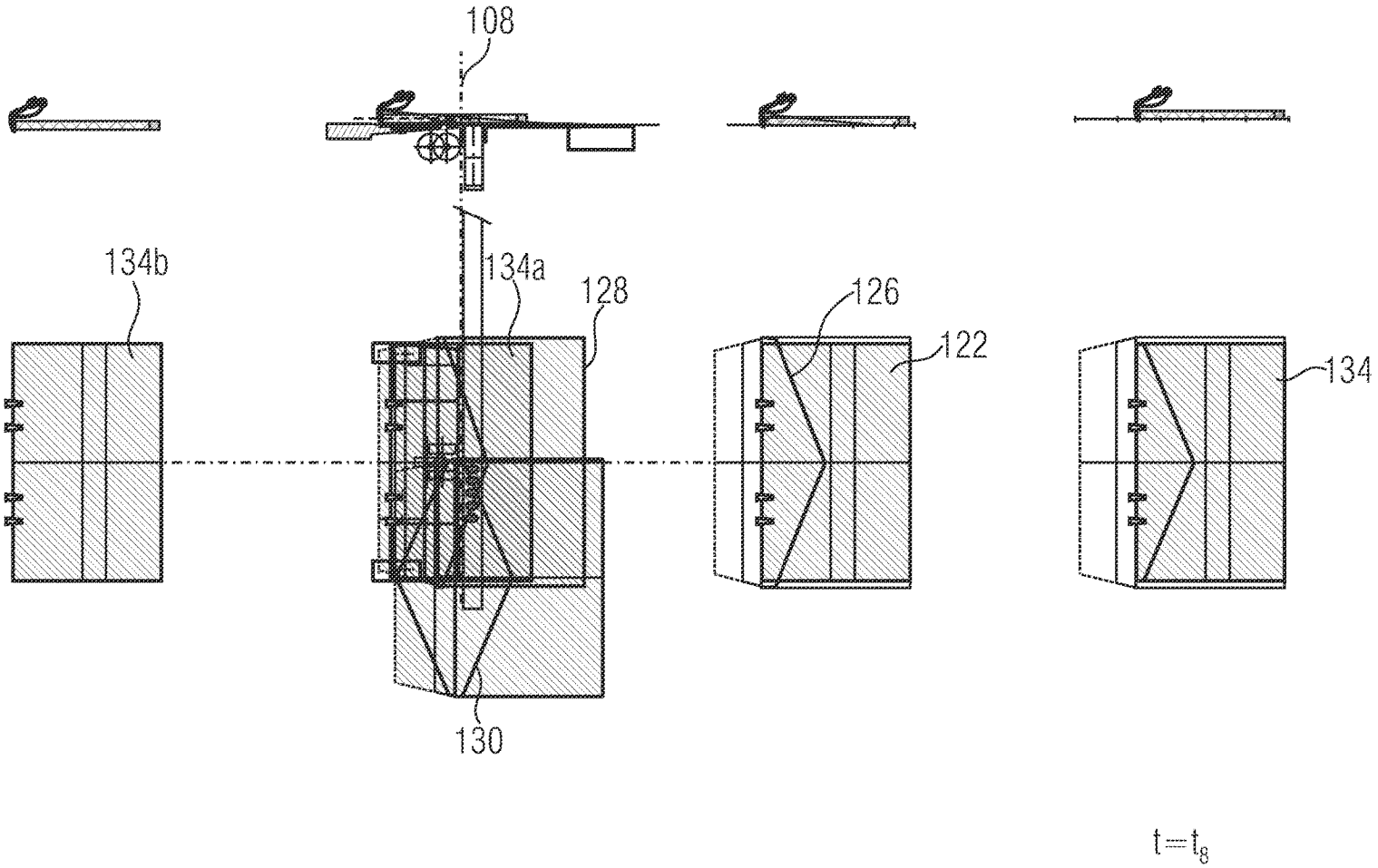
Figure 11:
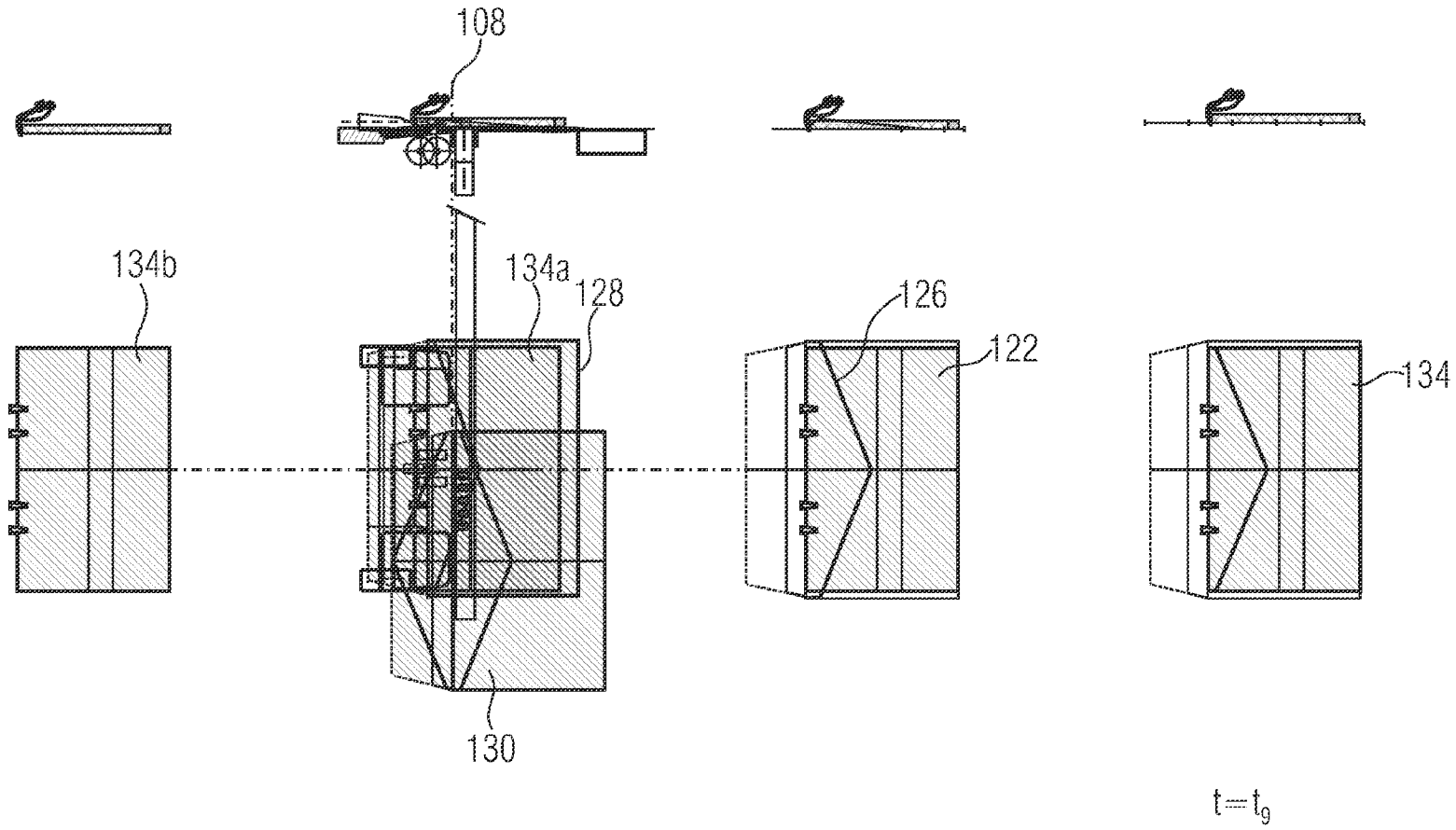
Figure 12:
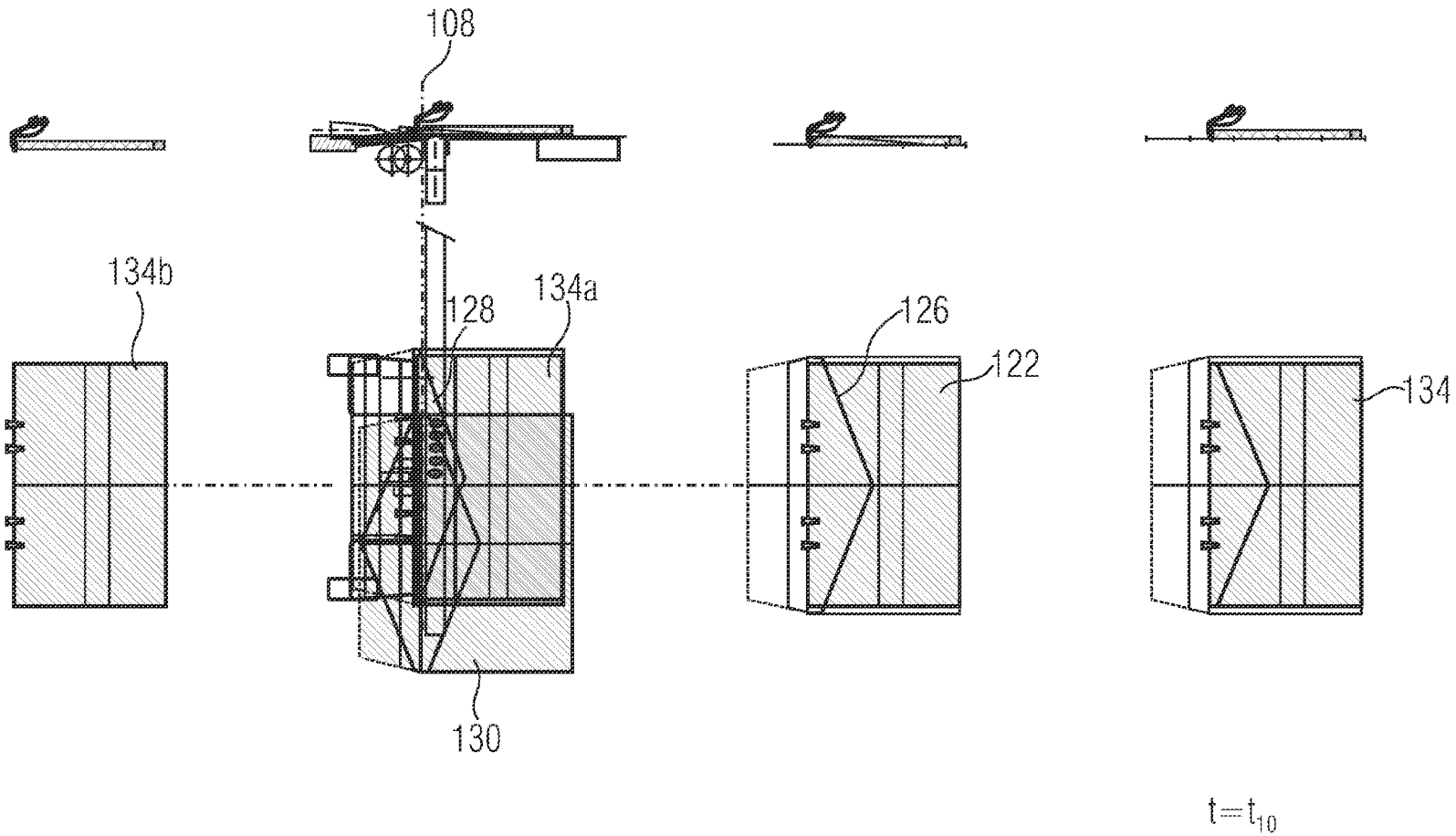
Figure 13:
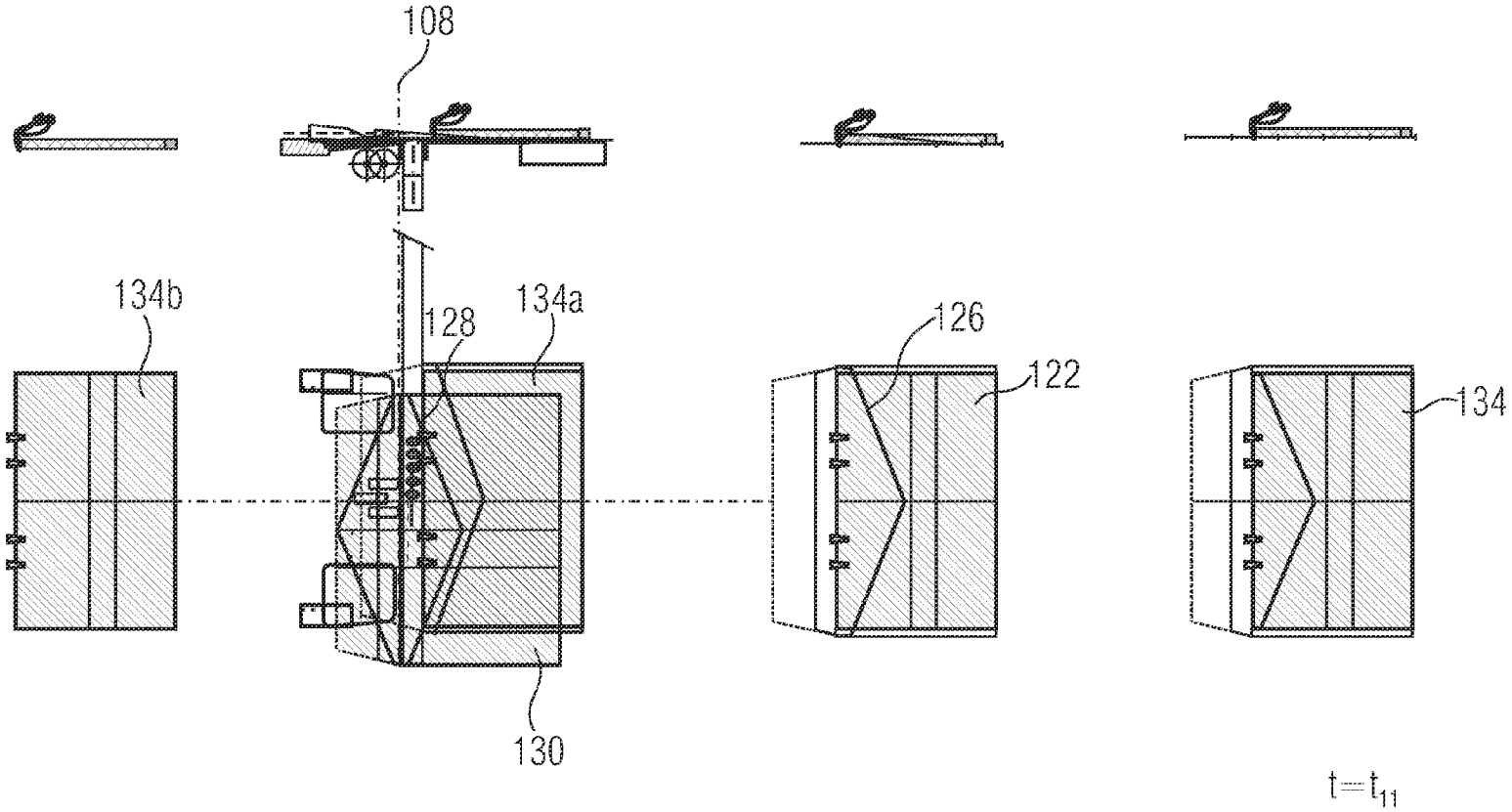

FIG. 6 shows the situation after $t=t_4$, wherein insertion of the filling material 134*a* into the envelope 128 pulled up onto the filling aid is started. The envelope 126 filled in the preceding cycle has now left the filling station and/or has left behind the area 104*c* of the envelope feeder 104. In the embodiment described, the envelope 128 newly to be filled is now pulled up onto the filling aid 100 and is at rest. The filling process starts by inserting the group of filling materials 124*a* into the envelope 128. During this filling process, while the envelope 128 is at rest, the envelope 130 is transported into the filling station. FIG. 6 represents the situation wherein the envelope 130 has already been introduced, to a small extent, into the filling station in the direction of the envelope transport direction $R_K$, as is shown by the overlapping area of the envelopes 128 and 130. The envelope 130 is transported in with its hinge line $HL_{130}$ aligned to the position 108, so that the envelope 130 is transported in outside the filling area.

FIGS. 7 to 13 show the position of the above-described elements after $t_5$, $t_6$, $t_7$, $t_8$, $t_9$, $t_{10}$, and $t_{11}$. Based on FIGS. 7 to 13, filling of the envelope 128 by inserting the group of filling materials 134*a* is shown, while the envelope 130 is introduced into the envelope feeder at the same time, so that finally the situation shown in FIG. 14 results, which in turn corresponds to the starting position explained by means of FIG. 2, namely that situation where the envelope 128 has been filled and where a further envelope 130 is already provided for receiving the further groups of filling materials 134*b*. Starting from the situation in FIG. 14, the above-described process for filling the envelope 130 and for simultaneously providing a further envelope is repeated.

Figure 14:
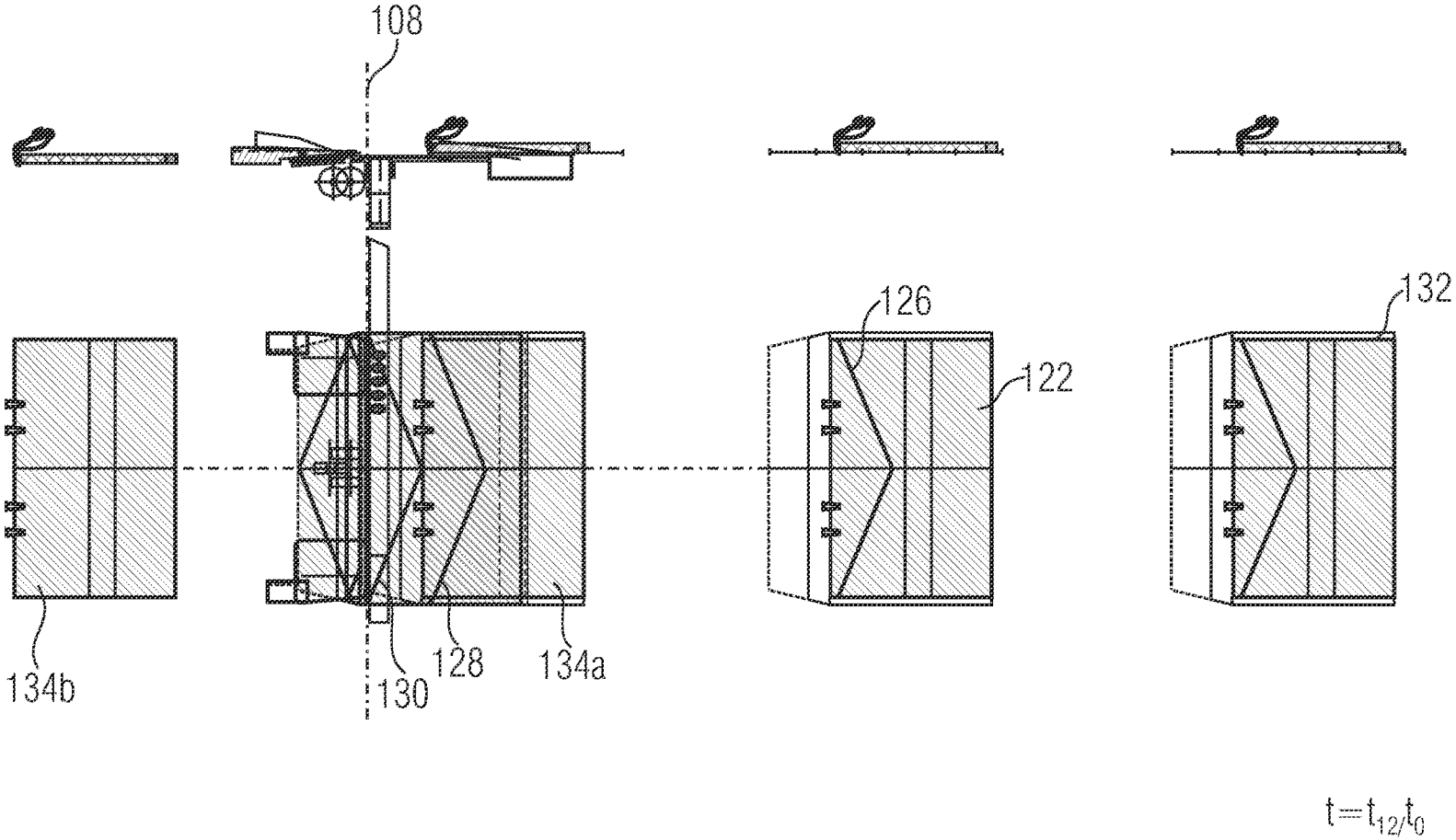

In the above-described embodiment, a subsequent envelope 130 is not transported in until the preceding envelope 128 has been pulled up onto the filling aid 100 so as to avoid movement overlaps in two directions, i.e. in the direction of the material transport and in the direction of the envelope transport. The filled envelope 128 is not output until the subsequent envelope 130 is completely transported in, as is shown in FIG. 14, so as to avoid movement overlaps in the two directions, namely the removal direction and the envelope feeding direction. Embodiments of the invention utilize this approach to facilitate process control; however, it shall be noted that the present invention is not limited to this configuration. In other embodiments, movement overlap in two directions may be allowed, so that the subsequent envelope is transported in while the preceding envelope is being pulled up onto the filling aid, and/or so that the filled envelope is being output while the subsequent envelope is transported in.

The filling aids are advantageously displaceable in the format area and are configured such that no gaps or edges will form where the envelope flap being supplied may abut or get caught.

Figure 15:
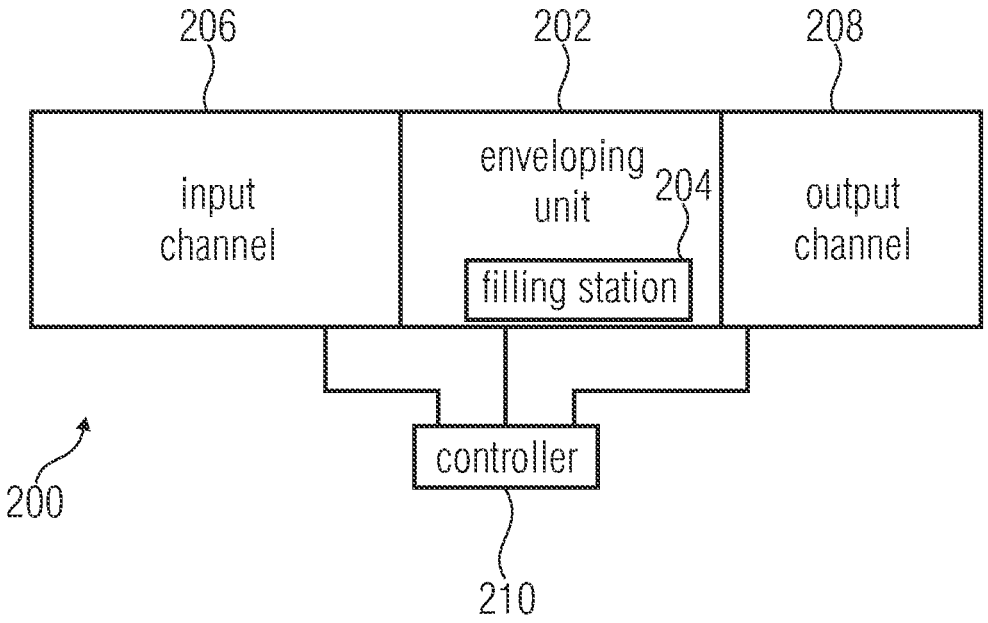
FIG. 15 shows a schematic representation of a paper handling system comprising an enveloping machine with a filling station in accordance with embodiments of the present invention.

FIG. 15 shows a schematic representation of a paper handling system 200 which includes an enveloping machine 202 comprising a filling station 204 in accordance with embodiments of the present invention. The paper handling system 200 may include one or more input channels, only one input channel 206 being shown by way of example in FIG. 15. The input channel includes different paper handling components, such as a cutter, a merger, a collating station, a folding unit and/or a gathering web comprising one or more insert leaders. In addition, the system 200 includes at least one output channel 208 for further processing of the enveloped goods, for example a franking unit or a sorting unit. In addition, a controller 210 is provided which controls the components in the input channel 206, in the output channel 208 and in the enveloping unit 202 as well as the filling station 204. Even though FIG. 15 shows a central controller 210, embodiments of the invention are not limited to such a configuration; rather, the controller may also be arranged within each of the components in a decentralized manner, and the corresponding control signals for the subsequent components are transmitted between the components.

Even though some aspects have been described within the context of a device, it is understood that said aspects also represent a description of the corresponding method, so that a block or a structural component of a device is also to be understood as a corresponding method step or as a feature of a method step. By analogy therewith, aspects that have been described in connection with or as a method step also represent a description of a corresponding block or detail or feature of a corresponding device. Some or all of the method steps may be performed while using a hardware device, such as a microprocessor, a programmable computer or an electronic circuit. In some embodiments, some or several of the most important method steps may be performed by such a device.

While this invention has been described in terms of several embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations and equivalents as fall within the true spirit and scope of the present invention.

The invention claimed is:

1. A filling station for filling an envelope, the filling station being configured to receive a filling material and an envelope, the filling station comprising:

a filling area comprising at least one filling aid;

an envelope feeding plane configured to receive an envelope and to arrange the envelope at least partly at a position outside the filling area; and a transport device configured to move an envelope, which is arranged in the envelope feeding plane, into the filling area;

the envelope feeding plane being configured to receive a subsequent envelope during a movement of the preceding envelope from the envelope feeding plane into the filling area and/or during filling of the preceding envelope, and to keep same outside the filling area, and the envelope feeding plane being configured to receive the subsequent envelope below a position where an envelope is filled so that, in operation, at least the envelope and the subsequent envelope are located one above the other simultaneously, the envelope within the filling area and the subsequent envelope are within the envelope feeding plane, the envelope and the subsequent envelope are arranged in an at least partially overlapping manner when viewed from above, wherein the filling area is the area in which the envelope and the subsequent envelope are arranged to completely or partly overlap, and wherein the transport device is configured to move the subsequent envelope out of the envelope feeding plane and into the filling area once filling of the preceding envelope has been completed and before discharge of the filled envelope from the filling area has been completed.

2. The filling station as claimed in claim 1, wherein the transport device is configured to move the envelope, which is arranged in the envelope feeding plane in the direction of the filling aid.

3. The filling station as claimed in claim 1, wherein the transport device is configured to pull or push the envelope.

4. The filling station as claimed in claim 1, wherein the envelope feeding plane is configured to hold an envelope bottom of the subsequent envelope in a downwardly deflected manner in relation to the rest of the envelope during transport into the envelope feeding plane.

5. The filling station as claimed in claim 4, wherein the envelope feeding plane is configured to release the envelope bottom before filling of the envelope is completed or before filling of the envelope is started.

6. The filling station as claimed in claim 4, wherein the envelope feeding plane comprises a support comprising an end which remote from the filling aid and is arranged below the position where an envelope is filled, so that the envelope bottom of an envelope transported into the envelope feeding plane is downwardly deflected in relation to the rest of the envelope.

7. The filling station as claimed in claim 1, wherein the filling aid is arranged to be movable or stationary.

8. The filling station as claimed in claim 1, comprising a further transport device configured to feed the subsequent envelope to the envelope feeding plane.

9. The filling station as claimed in claim 8, wherein the further transport device is configured to feed the subsequent envelope to the envelope feeding plane in a material transport direction, perpendicularly to the material transport direction or counter to the material transport direction.

10. The filling station as claimed in claim 8, wherein the further transport device is configured to receive a plurality of envelopes in a shingled manner.

11. The filling station as claimed in claim 8, wherein the further transport device comprises a suction-belt transport device.

12. The filling station as claimed in claim 1, wherein the transport device comprises a cylinder segment roller.

13. The filling station as claimed in claim 1, comprising a removal device configured to remove the filled envelope, the removal device being configured to be activated once the filling material has been inserted into the envelope.

14. The filling station as claimed in claim 1, comprising at least one filling slide configured to insert a filling material into the envelope pulled up onto the filling aid.

15. The filling station as claimed in claim 14, wherein the filling slide is further configured to discharge the filled envelope.

16. The filling station as claimed in claim 1, configured to receive a filling material, which is being moved in a first direction, and the envelope from a second direction, which is opposite the first direction, the envelope feeding plane being configured to receive the subsequent envelope from a third direction.

17. A paper handling system, comprising:

one or more paper handling components for providing a filling material;

a filling station as claimed in claim 1; and a controller effective to control the paper handling component and the filling station.

18. A method of filling an envelope in a filling station which receives a filling material and an envelope, comprising:

moving an envelope from an envelope feeding plane in the direction of a filling aid of the filling station, inserting a filling material into the envelope, and during movement of the envelope from the envelope feeding plane to the filling aid and/or during filling of the envelope, receiving a subsequent envelope in the envelope feeding plane such that at least part of the received envelope is arranged outside a filling area, the subsequent envelope being received below a position wherein an envelope is filled so that, in operation, at least the envelope and the subsequent envelope are located one above the other simultaneously, the envelope within the filling area and the subsequent envelope are within the envelope feeding plane, the envelope and the subsequent envelope are arranged in an at least partially overlapping manner when viewed from above, wherein the filling area is the area in which the envelope and the subsequent envelope are arranged to completely or partly overlap, and wherein the subsequent envelope is moved out of the envelope feeding plane to the filling aid after filling of the preceding envelope has been completed and before discharge of the filled envelope from the filling area has been completed.

* * * * *